US006508364B2

(12) United States Patent
Kreft et al.

(10) Patent No.: US 6,508,364 B2
(45) Date of Patent: Jan. 21, 2003

(54) SIEVING DEVICE

(75) Inventors: Manfred Kreft, Nottuln-Darup (DE); Josef Zuber, Nottuln (DE)

(73) Assignee: Jöst GmbH + Co. KG, Dülmen-Buldern (DE)

( * ) Notice: Subject to any disclaimer, the term of this patent is extended or adjusted under 35 U.S.C. 154(b) by 3 days.

(21) Appl. No.: 09/768,216

(22) Filed: Jan. 24, 2001

(65) Prior Publication Data

US 2001/0017275 A1 Aug. 30, 2001

(30) Foreign Application Priority Data

Jan. 25, 2000 (DE) ..... 100 03 172

(51) Int. Cl.[7] ..... B07B 1/28
(52) U.S. Cl. ..... 209/309; 209/320; 209/365.1
(58) Field of Search ..... 209/309, 320, 209/322, 325, 327, 329, 330, 341, 363, 365.1, 365.3, 370, 372, 373, 404, 413, 455, 485, 486, 920, 921

(56) References Cited

U.S. PATENT DOCUMENTS 2,225,909 A * 12/1940 Gruender ..... 209/311
2,279,742 A * 4/1942 Overstrom et al. ..... 209/315
2,285,678 A * 6/1942 Overstrom et al. ..... 209/315
3,378,142 A * 4/1968 Wehner ..... 209/325
4,504,386 A * 3/1985 Dyren et al. ..... 209/254
4,655,907 A * 4/1987 Ando ..... 209/404
5,981,892 A * 11/1999 Baird et al. ..... 209/590

FOREIGN PATENT DOCUMENTS

DE 1 206 372 12/1965
DE 32 14 943 A1 * 10/1983 ..... B07B/1/36
DE 35 03 125 8/1985
DE 36 11 234 C1 * 10/1987 ..... B07B/1/46

* cited by examiner

*Primary Examiner*—Donald P. Walsh
*Assistant Examiner*—Mark J Beauchaine
(74) *Attorney, Agent, or Firm*—Nixon Peabody LLP; David S. Safran

(57) ABSTRACT

A sieving device and the operation of a sieving device are proposed. The sieving device has a supporting frame which can be made to vibrate and a vibration frame which is held so as to be able to vibrate freely in relation to said supporting frame. A simple, compact design which provides good sieving and conveying performance is achieved in that the vibration frame is spring-elastically coupled to the supporting frame by helical springs, with the main spring axes of the spring elements extending in the direction of vibration of the tension waves. Furthermore, guiding elements for movable bearing arrangement of the vibration frame on the supporting frame are provided. The sieving device is operated in particular at a vibration frequency of at least 850 vibrations per minute at an average speed of approx. 11 m/s and at an average acceleration of the vibration frame relative to the supporting frame of approx. 2.2 m/s$^2$.

33 Claims, 2 Drawing Sheets

SIEVING DEVICE

BACKGROUND OF THE INVENTION

1. Field of the Invention

The present invention relates to a sieving device with a supporting frame which can be made to vibrate with a vibration drive associated with and exclusively acting upon the supporting frame, and a vibration frame held against the supporting frame via spring elements and spring-elastically coupled to the supporting frame, in which the vibration frame can vibrate in at least essentially free vibration in one direction of vibration (of tension waves), and in which the supporting frame and the vibration frame comprise transverse supports which are alternately arranged one behind the other in the direction of vibration of tension waves and which can carry sieve bottom elements which can alternately be tensioned and untensioned in the direction of vibration of tension waves. Further, the present invention relates to a method for operating such a sieving device. The invention particularly relates to such a sieving device used for materials which are difficult to sieve, such as moist, sticky, caking materials and/or materials containing long fibres.

2. Description of Related Art

German Patent DE 35 03 125 C2, which forms the starting point of the present invention, discloses a sieving device with the characteristics mentioned above, comprising a supporting frame which can be made to vibrate, and a vibration frame held to the supporting frame by spring elements so as to be able to vibrate. The transverse supports of the vibration frame extend outwardly through window-like apertures in lateral side plates of the supporting frame, where they are connected to longitudinal supports of the vibration frame. Spring elements in the form of thrust-type rubber blocks are arranged preferably at several locations on each longitudinal support in the longitudinal direction, opposing each other in pairs on both sides of a longitudinal support. The thrust-type rubber blocks represent the only bearing arrangement of the vibration frame on the supporting frame, so that the vibration frame can carry out a vibration movement in relation to the supporting frame; said vibration movement being determined by the thrust-type rubber elements and being largely linear. To generate vibration, a vibration drive, which in particular is in the form of a circular vibration drive, is associated with the supporting frame, said circular vibration drive acting exclusively on the supporting frame and only indirectly via the thrust-type rubber blocks on the vibration frame. Thus, the vibration frame can vibrate freely. Such a known sieving device has a number of disadvantages.

The spring constant of thrust-type rubber blocks greatly depends on the temperature of the thrust-type rubber blocks. Accordingly, the vibration behavior greatly depends on the temperature.

Thrust-type rubber blocks are relatively prone to ageing. Correspondingly, the vibration behavior changes over time; in particular, it worsens.

During vibration, relatively substantial internal friction in the thrust-type rubber blocks must be overcome, resulting in a substantial heating effect. However, the thrust-type rubber blocks must not exceed certain temperature limits or otherwise they harden. Accordingly, in the known sieving device, the extent of vibration, i.e., amplitude and frequency, or average speed and acceleration, is very limited. The vibration frequency achievable over an extended period is essentially a maximum of 800 vibrations per minute.

By fixing the longitudinal supports between the thrust-type rubber blocks which are arranged so as to oppose each other in pairs, the vibration forces—i.e., vibrations—transverse to the essentially horizontal vibration of the tension waves of the vibration wave, are to be suppressed so that essentially only linear vibration takes place. However, in the known sieving device, superposition of transverse vibration cannot be prevented altogether, so that the thrust-type rubber blocks additionally vibrate in this transverse direction, and thus, additionally heat up. This has the effect of additionally reducing the vibration frequency and/or vibration amplitude which are available at the most for vibration of tension waves, i.e., movement of the sieve (bottom) elements.

Usually during sieving, the material to be sieved is to be conveyed in one sieving direction along the sieve surface formed by the sieve bottom elements. To this effect, the vibration acting on the supporting frame normally has a respective main direction of effect (direction of sieving). In order to achieve adequate conveyance in the direction of sieving, an inclination of the vibration frame or of the direction of vibration of tension waves is required. In the known sieving device, the usually straight shape of the longitudinal supports of the vibration frame require an angle of inclination of the vibration frame of approx. 12° to 16° in relation to horizontal, so as to achieve adequate conveyance in sieving direction. Due to the design length of such a sieving device, this requires an undesirably high design height.

German Patent 1 206 372 discloses a similar sieving device with a vibration frame which can be made to vibrate relative to a supporting frame, thus causing alternate tensioning and untensioning of sieve bottom elements which are held by transverse supports of the frames. Preferably, a vibration device is provided which acts directly on both the supporting frame and the vibration frame so that a compulsorily or positively controlled, circular vibration of the vibration frame relative to the supporting frame is generated. For this purpose, springs acting between the supporting frame and the vibration frame are exclusively used to provide movable support or guidance.

In contrast to the already mentioned free vibration of the vibration frame, compulsorily or positively controlled vibration generation involves increased design expenditure. In addition, the above-mentioned sieving device is associated with disadvantages similar to the sieving device according to German Patent DE 35 03 125 C2.

German Patent 1 206 372 describes two alternative embodiments in which the vibration frame is held so as to vibrate freely, i.e., the vibration drive does not act directly on the vibration frame. In this embodiment, the vibration frame is held by spring elements which are rubber blocks installed between longitudinal supports of the vibration frame and the supporting frame. In addition, as is the case in German Patent DE 35 03 125 C2, these spring elements are exposed to shear forces. Correspondingly, these alternative embodiments also involve disadvantages as in German Patent DE 35 03 125 C2.

SUMMARY OF THE INVENTION

It is a main object of the present invention to provide a sieving device with a freely vibrating vibration frame of the "vibration of tension waves" type, as well as a method for operating such a sieving device, which allows more effective sieving, in particular of materials which are difficult to sieve, wherein the device and method in particular avoid or at least minimize the disadvantages of the prior art while allowing a simple, compact design.

The above object is achieved by a sieving device in which the supporting frame and the vibration frame comprise transverse supports which are alternately arranged one behind the other in the direction of vibration and which are adapted to carry sieve bottom elements which can be tensioned and untensioned in the direction of vibration, the spring elements being helical springs with main spring axes that are at least essentially aligned in the direction of vibration, and wherein, in addition to the spring elements, guiding elements are provided for bearing or holding the vibration frame at the supporting frame.

A significant idea of the present invention lies in providing helical spring elements acting in the direction of vibration (of tension waves), for movable coupling between the vibration frame and the supporting frame, and furthermore, in providing additional guiding elements which hold or guide the vibration frame at least essentially freely in the direction of vibration (of tension waves). This results in several advantages.

The helical spring elements, which are preferably made of steel, can withstand very considerable loads, and accordingly, they withstand vibrations at high amplitude and high frequency even over extended periods. Accordingly, higher acceleration during tensioning of the sieve bottom elements, and consequently, an increased or improved sieving performance, can be achieved. Greater acceleration is also beneficial for conveying the material to be sieved in the sieving direction. This is an additional reason for being able to reduce the inclination of the vibration frame and/or the direction of vibration in the sieving device according to the invention, when compared to the prior art, for example, to 3° to 5° relative to horizontal. This results in a correspondingly considerably lower design height.

The helical spring elements provided are significantly less sensitive than thrust-type rubber blocks. In particular, the helical spring elements are quasi temperature-independent, thus providing for more universal application, without there being any danger of overheating. In addition, the service life of helical spring elements is significantly longer than those of thrust-type rubber blocks. Consequently, there is a reduction in costs of operation and maintenance.

A further significant aspect of the solution according to the invention is that the guide elements provided in addition to the spring elements, hold or guide the vibration frame such that it is essentially free, and is at least movably guided essentially in the direction of vibration of the sieve. Thus, the desired vibration movement can easily be specified in an optimal way, with the spring coupling between the supporting frame and the vibration frame being able to be set and realized independently thereof. Accordingly, at least in essence, a linear vibration movement of the vibration frame, relative to the supporting frame, can be specified resulting in a main direction of vibration. This is beneficial for an optimal sieving effect and good conveyance in the sieving direction. It also essentially prevents the spring elements from being exposed to shear forces; a factor which is beneficial to their service life.

When the main direction of effect of the vibration drive extends diagonally to the direction of vibration, as is usual, in particular, to achieve good conveyance of the material to be sieved in the sieving direction, the guiding elements can prevent interfering vibrations of the vibration frame transversely to the direction of vibration.

A further aspect of the present invention provides for the sieving device to be operated or to be operable at an increased vibration frequency compared to the prior art, namely, at least 850 vibrations per min., and in particular, at approx. 890 vibrations per min. In this way, in particular, an average speed of the vibration frame relative to the supporting frame of preferably at least 11 m/min and an average acceleration of preferably at least 2.2 $m/s^2$ is achieved. In this way, a very strong vibration can be achieved which allows more effective sieving. Furthermore, better conveyance in the sieving direction of the material to be sieved is achieved, so that the inclination of the vibration frame or the direction of vibration can be significantly reduced, in particular to 3° to 5° relative to horizontal. Correspondingly, the required design height of the sieving device can be reduced.

Further details, characteristics, properties, advantages and objects of the present invention are shown in more detail below by means of the drawing of a preferred embodiment.

DETAILED DESCRIPTION OF THE INVENTION

Figure 1:
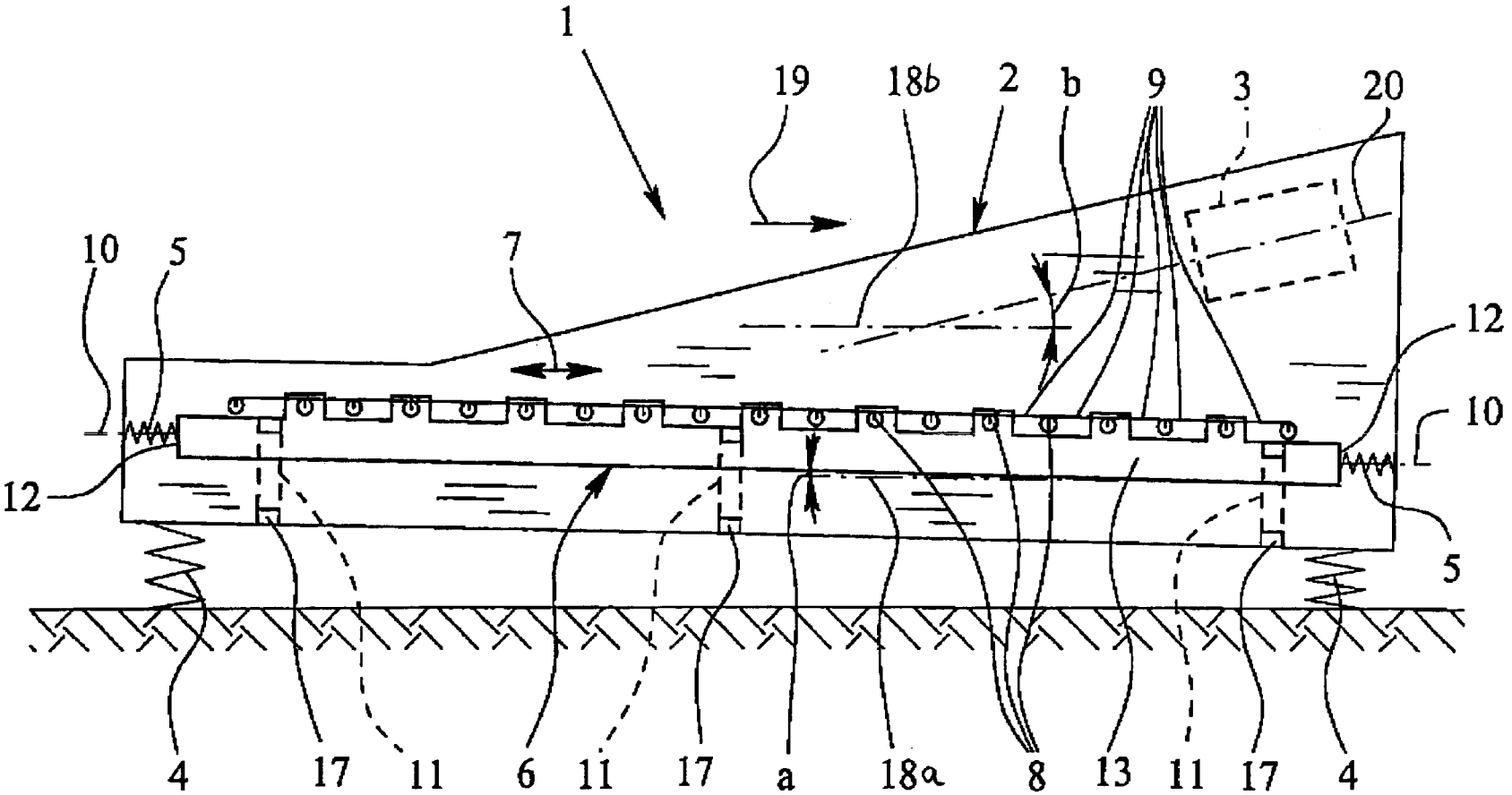
FIG. 1 is a diagrammatic longitudinal sectional view of a sieving device according to the invention.

FIG. 1 shows a sieving device I according to a preferred embodiment of the present invention. It comprises a supporting frame 2 which can be made to vibrate by means of an associated vibration drive 3. The vibration drive 3 which is indicated by a dashed line is in particular connected to the supporting frame 2 or held by said supporting frame 2. Preferably, the vibration drive 3 is a linear vibration drive, i.e., at least essentially only linear vibrations are generated.

The supporting frame 2 is held or supported in such a way that it can vibrate. To this effect, in the embodiment shown, the supporting frame 2 is held by diagrammatically shown support springs 4, and in particular, installed on said support springs 4.

On the supporting frame 2, spring elements 5 are supported by way of a vibration frame 6 which is spring-elastically coupled to the supporting frame 2. The vibration frame 6 is held to the supporting frame 2 such that it can freely move back and forth essentially at least in one direction 7 of vibration (of tension waves), i.e., it is not compulsorily or positively controlled but instead it is under the influence of the spring elements 5, so as to carry out vibration which in this document is also called "vibration of tension waves". Preferably the vibration frame 6 can at least essentially vibrate exclusively in the main direction 7 of vibration.

Figure 2:
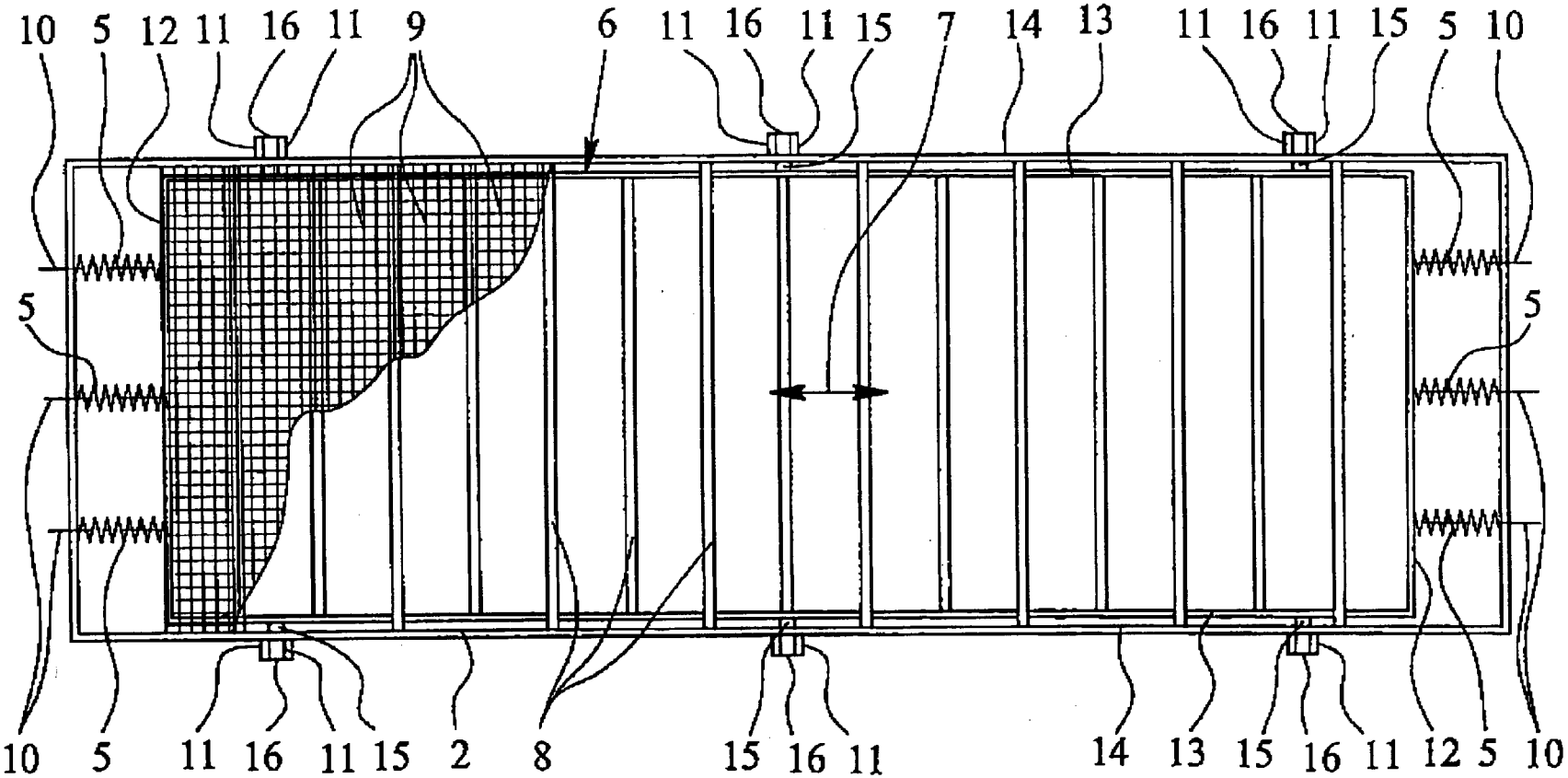
FIG. 2 is a simplified top view of the sieving device according to FIG. 1.

FIGS. 1 & 2 show that transverse supports 8 are arranged at, or are supported by, the supporting frame 2 and the vibration frame 6. The transverse supports 8 at least essentially extend horizontally and transversely to the direction 7 of vibration. The transverse supports 8 are arranged one behind the other in the direction 7 of vibration, at least essentially in one plane. They are alternately supported either by the supporting frame 2 or by the vibration frame 6. If the vibration frame 6 vibrates to and for in the direction 7 of vibration of tension waves, the spacing between adjacent transverse supports 8 is accordingly increased and decreased alternately. This causes sieve (bottom) elements (mats or screens) 9, which are supported by the transverse supports 8 and which preferably extend from one transverse support 8 to the next, to be tensioned and untensioned, alternately. This results in high acceleration of material to be sieved (not shown) which is located on the sieve bottom elements 9 so that even material which is difficult to sieve can be sieved or classified.

The sieve bottom elements or sieve bottom mats or screens 9 are in particular individually exchangeable and are made so as to be sufficiently flexible, as generally known from the prior art.

In the proposed sieving device 1, the spring elements 5 are helical springs made of steel. The main spring directions or spring axes 10 of the spring elements 5 are at least essentially aligned in the direction 7 of vibration.

The helical springs constituting the spring elements 5 can preferably be subjected to both tension and pressure and are installed accordingly. However, the spring elements 5 can, for example, also be installed so as to be tensioned in such a way that, during operation, they are subjected only to tension or only to pressure.

In addition, guiding elements 11 are provided which act between the supporting frame 2 and the vibration frame 6 and which preferably exclusively support the vibration frame 6 on the supporting frame 2 with adequate movement in the direction 7 of vibration.

The above-mentioned decoupling of the guide as well as the spring-elastic vibration coupling by the spring elements 5 and the guiding elements 11 results in the spring elements 5 being at least essentially subjected to forces exclusively in their optimal main spring direction (spring axes 10), and for example, at least essentially not being subjected to shearing forces. This makes it possible to provide an optimal design of the spring elements 5 so that optimal or improved vibration behaviour of the sieving device 1 can be achieved. This will be discussed in detail below. Due to exposure to merely optimal loads, the service life of the spring elements 5 is also very long. There is a further advantage in that helical springs, which are available relatively economically, can be used as spring elements 5.

The spring elements 5 are arranged in the area of transverse sides 12 of the vibration frame 6; in particular, the spring elements 5 directly engage the transverse sides 12. This results in a simple, compact design of the sieving device 1.

In the embodiment shown, the vibration frame 6 is arranged at least essentially within the supporting frame 2. In particular longitudinal supports 13 of the vibration frame 6 are arranged on the inside of side plates or portions 14 of the supporting frame 2. This allows a simple design because the transverse supports 8 of the vibration frame 6 do not penetrate the side plates or portions 14 of the supporting frame 2. Of course other embodiments are also possible.

In this embodiment, the guiding elements 11 are preferably at least essentially made in a leaf-spring manner. The vibration frame 6 comprises lateral projections 15 which can, for example, also be formed by lateral extensions of the transverse sides 12. Preferably, the projections 15 are fixed in the manner of lugs to the vibration frame 6, and in particular, to the longitudinal supports 13.

The projections 15 extend outward through respective recesses in the side plates 14 and are held at their free end 16 by the guiding elements 11, and in this particular case, two leaf springs each, whose other end is supported by the supporting frame 2, especially by lower projections 17 on the side plates 14 of the supporting frame 2.

The above-mentioned guiding elements 11 provide simple and effective guidance of the vibration frame 6, with the vibration frame 6 being movable back and forth in the direction 7 of vibration relatively easily or at least adequately easily. Due to the leaf spring like design, the vibration frame 6, strictly speaking, does not carry out any straight-line or linear vibration movements, and instead moves or alternates along a slightly curved orbit. However, since the excursion or vibration amplitude is relatively slight, in particular approximately ±3.2 to 3.5 mm, the vibration movement defining direction 7 of vibration can be regarded as being at least essentially linear. Furthermore, tests have shown that such movement of vibration results in very effective sieving.

The sieving device 1 according to the proposal provides a particular advantage in that vibration absorption of the vibration frame 6 relative to the supporting frame 2 is relatively slight, so that relatively little absorption effort needs to be expended during operation, and unnecessary heating of the moving or elastically deforming components, in particular of the spring elements 5, is avoided.

The total mass or vibrating mass of the supporting frame 2 is preferably at least essentially larger by a factor of 10 than the total mass or vibrating mass of the vibration frame 6 including the sieve bottom elements 9.

In the embodiment shown, the direction 7 of vibration or the plane of the main direction of alignment of the vibration frame 6, is inclined at an angle a relative to horizontal plane 18*a* in the sieving direction 19, i.e., in the direction in which the material to be sieved is transported or conveyed over the sieve bottom elements 9, provided it does not fall through the sieve bottom elements 9. Preferably, the angle of inclination a is approx. 3° to 5°. This is a surprisingly shallow angle but it is sufficient in the sieving device 1 according to the illustrated embodiment, for conveyance in the sieving direction 19.

The main direction of vibration 20 of the vibration carried out on the supporting frame 2 by the vibration drive 3, is against the sieving direction 19, inclined at angle b relative to horizontal plane 18*b*. In this case, the angle of inclination b is preferably between 3° and 5°, in particular essentially 40°.

Preferably, the sieving device 1 is designed such that the resonance frequency is at least 1100 vibrations per minute, and in particular, at least 1200 vibrations per minute. This allows sub-critical operation of the sieving device 1, i.e., vibration below the resonance frequency at a significantly higher vibration frequency compared to the prior art.

The sieving device 1 according to the invention is preferably designed such that it can be operated at a vibration frequency of at least 850 vibrations per minute, and in particular, essentially at 890 vibrations per minute or higher. The vibration drive 3 is designed accordingly. The vibration frame 6 then vibrates in the direction 7 of vibration of tension waves. The amplitude is, in particular, approx. ±3.2 to 3.5 mm. In this way, an average speed of the vibration frame 6 relative to the supporting frame 2 is in excess of 11 m/min and an average acceleration of at least 2.2 $m/s^2$ can be achieved. Also, this enables vibration to be achieved which is considerably improved when compared to the prior art, such improved vibration resulting in a correspondingly more effective sieving and improved conveyance of material to be sieved in the sieving direction 19.

We claim:

1. A sieving device comprising:

a vibratable supporting frame;

a vibration frame;

a vibration drive associated with and exclusively acting upon said supporting frame, said vibration frame being held against said supporting frame via spring elements and being spring-elastically coupled to said supporting frame in a manner enabling said vibration frame to vibrate at least essentially freely in one direction of vibration;

wherein the supporting frame and the vibration frame comprise transverse supports which are alternately arranged one behind the other in the direction of vibration and which are adapted to carry sieve bottom elements which can be tensioned and untensioned in the direction of vibration;

wherein the supporting elements are helical springs having main spring axes which are at least essentially aligned in the direction of vibration; and wherein, in addition to the spring elements, guiding elements are provided for bearing or holding the vibration frame at the supporting frame.

2. The sieving device according to claim 1, wherein the spring elements are installed in a manner subjected to both tension and pressure.

3. The sieving device according to claim 1, wherein the spring elements have a spring constant of 150 to 300 N/mm.

4. The sieving device according to claim 1, wherein the spring elements have a spring constant of of 190 to 250 N/mm.

5. The sieving device according to claim 1, wherein the spring elements have a spring constant of 220 N/mm.

6. The sieving device according to claim 1, wherein the spring elements are exclusively arranged in a region of two transverse sides of the vibration frame.

7. The sieving device according to claim 1, wherein the spring elements are arranged within the supporting frame.

8. The sieving device according to claim 1, wherein the vibration frame is at least essentially arranged within the supporting frame.

9. The sieving device according to claim 1, wherein the vibration frame comprises projections which the guiding elements engage.

10. The sieving device according to claim 9, wherein the projections extend outward through respective recesses in side portions of the supporting frame, with the guiding elements engaging the free ends of the projections.

11. The sieving device according to claim 1, wherein the guiding elements are at least one leaf-spring shaped, and essentially freely movably in the direction of vibration.

12. The sieving device according to claim 11, wherein the guiding elements are provided for exclusive bearing of the vibration frame at the supporting frame.

13. The sieving device according to claim 1, wherein the guiding elements are provided for exclusive bearing of the vibration frame at the supporting frame.

14. The sieving device according claim 1, wherein the sieving device has a resonance frequency vibration which exceeds 1100 vibrations per minute.

15. The sieving device according claim 1, wherein the sieving device has a resonance frequency vibration which exceeds 1200 vibrations per minute.

16. The sieving device according to claim 1, wherein the sieving device is operable at a sub-critical vibration frequency.

17. The sieving device according to claim 1, wherein the sieving device is operable at a vibration frequency exceeding 850 vibrations per minute.

18. The sieving device according to claim 1, wherein the sieving device is operable at a vibration frequency of essentially 890 vibrations per minute.

19. The sieving device according to claim 1, wherein the average speed of the vibration frame relative to the supporting frame exceeds 10 m/minute.

20. The sieving device according to claim 1, wherein the average speed of the vibration frame relative to the supporting frame exceeds 11 m/minute.

21. The sieving device according to claim 1, wherein the average speed of the vibration frame relative to the supporting frame is essentially 12 m/minute.

22. The sieving device according to claim 1, wherein the sieving device, during operation, has an average acceleration of the vibration frame relative to the supporting frame which exceeds 2 $m/s^2$.

23. The sieving device according to claim 1, wherein the sieving device, during operation, has an average acceleration of the vibration frame relative to the supporting frame which is at least essentially 2.2 $m/s^2$.

24. The sieving device according claim 1, wherein a ratio of a total mass of the supporting frame including the vibration drive, insofar as said vibration drive is supported by the supporting frame, to the total mass of the vibration frame exceeds 5.

25. The sieving device according claim 1, wherein a ratio of a total mass of the supporting frame including the vibration drive, insofar as said vibration drive is supported by the supporting frame, to the total mass of the vibration frame exceeds 8.

26. The sieving device according claim 1, wherein a ratio of a total mass of the supporting frame including the vibration drive, insofar as said vibration drive is supported by the supporting frame, to the total mass of the vibration frame is essentially 10.

27. The sieving device according to claim 1, wherein a main direction of alignment of at least one of the vibration frame and a sieving surface formed by sieve bottom elements is inclined by at most 10° relative to horizontal in the direction of the vibration.

28. The sieving device according to claim 1, wherein a main direction of alignment of at least one of the vibration frame and a sieving surface formed by sieve bottom elements is inclined by at most 8° relative to horizontal in the direction of the vibration.

29. The sieving device according to claim 1, wherein a main direction of alignment of at least one of the vibration frame and a sieving surface formed by sieve bottom elements is inclined by essentially between 5° and 3° relative to horizontal in the direction of the vibration.

30. The sieving device according to claim 1, wherein a vibration drive acts on the supporting frame in an at least essentially linear main direction of vibration.

31. The sieving device according to claim 30, wherein the main direction of vibration is inclined relative to horizontal between 30° and 50°.

32. The sieving device according to claim 30, wherein the main direction of vibration is inclined relative to horizontal essentially by 40°.

33. A method for operating a sieving device with a vibrating supporting frame, with a vibration drive associated with and exclusively acting upon said supporting frame, and with a vibration frame held against said supporting frame via spring elements and spring-elastically coupled to said supporting frame, wherein the supporting frame and the vibration frame comprise transverse supports which are alternately arranged one behind the other in the direction of vibration and which are adapted to carry sieve bottom elements which can alternately be tensioned and untensioned in the direction of vibration, comprising the steps of:

vibrating the vibration frame at least essentially freely in one direction of vibration, operating the sieving device at a sub-critical vibration frequency exceeding 850 vibrations per minute, and at least at one of an average speed of the vibration frame relative to the supporting frame of at least 11 m/min and an average acceleration of the vibration frame relative to the supporting frame of at least 2.2 $m/s^2$.

* * * * *